US006464541B1

(12) United States Patent
Hashim et al.

(10) Patent No.: US 6,464,541 B1
(45) Date of Patent: Oct. 15, 2002

(54) SIMULTANEOUS NEAR-END AND FAR-END CROSSTALK COMPENSATION IN A COMMUNICATION CONNECTOR

(75) Inventors: Amid I. Hashim, Randolph, NJ (US); Wayne D. Larsen; Swarna Prabha, both of Indianapolis, IN (US); Charles A. Tenorio, Fishers, IN (US); Julian R. Pharney, Indianapolis, IN (US); Dennis L. Troutman, Huntsville, AL (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/863,625

(22) Filed: May 23, 2001

(51) Int. Cl.[7] ..... H01R 23/02
(52) U.S. Cl. ..... 439/676; 439/620; 439/941
(58) Field of Search ..... 439/676, 941, 439/188, 620

(56) References Cited

U.S. PATENT DOCUMENTS 5,700,167 A 12/1997 Pharney et al.
5,911,602 A * 6/1999 Vaden ..... 439/676
5,997,358 A 12/1999 Adriaenssens et al.
6,089,923 A * 7/2000 Phommachanh ..... 439/676
6,109,943 A * 8/2000 Arnett ..... 439/941
6,139,371 A 10/2000 Troutman et al.
6,176,742 B1 * 1/2001 Arnett et al. ..... 439/620
6,196,880 B1 3/2001 Goodrich et al.

OTHER PUBLICATIONS

Bell Laboratories, Transmission System For Communications (5th ED. 1982) at pp. 127–132.

* cited by examiner

*Primary Examiner*—Gary F. Paumen
*Assistant Examiner*—Felix O. Figueroa

(57) ABSTRACT

A scheme for compensating for both near-end (NEXT) and far-end (FEXT) crosstalk within a communication connector having first and second pairs of contact wires. A first stage of compensation includes capacitive coupling that corresponds in magnitude to a sum of offending capacitive and offending inductive crosstalk both of which originate from a mating connector. At a second stage of compensation, both (a) inductive coupling corresponding in magnitude to the offending inductive crosstalk, and (b) capacitive coupling corresponding in magnitude and of opposite polarity to the inductive coupling, are produced. In the disclosed embodiment, the first and the second compensation stages are implemented in an industry type RJ-45 communication jack to meet or surpass Category 6 NEXT/FEXT loss levels.

12 Claims, 4 Drawing Sheets

SIMULTANEOUS NEAR-END AND FAR-END CROSSTALK COMPENSATION IN A COMMUNICATION CONNECTOR

BACKGROUND OF THE INVENTION

1. Field of the Invention

This invention relates to communication connectors that are configured to compensate for offending crosstalk.

2. Discussion of the Known Art

Communication connectors that are configured to suppress or to compensate for crosstalk that originates from within a mating connector, are generally known. As defined herein, crosstalk arises when signals conducted over a first path, e.g., a pair of contact wires in a communication plug connector, are partly coupled electromagnetically into a second signal path (e.g., another pair of contact wires) within the same connector. The signals coupled from the first path may be detected as "crosstalk" in the second path, and such crosstalk degrades existing signals that are being routed over the second path.

Applicable industry standards for rating connector crosstalk performance are given in terms of near-end crosstalk (NEXT) and far-end crosstalk (FEXT). The ratings are usually specified for mated plug and jack combinations, and input terminals of the plug connector may be used as a reference plane. NEXT is defined as crosstalk whose power travels in an opposite direction to that of an originating, disturbing signal in a different path. FEXT is defined as crosstalk whose power travels in the same direction as the disturbing signal in the different path. See, e.g., "Transmission Systems For Communications", Bell Telephone Laboratories (5th ed. 1982), at page 130. Communication links using unshielded twisted pairs (UTP) of copper wire are now expected to meet industry "Category 6" standards which call for at least 54 dB NEXT loss and 43 dB FEXT loss, each at 100 MHz, with respect to any two signal paths through the mated connectors.

Crosstalk compensation circuitry may be provided on or within layers of a printed wire board to which the contact wires of a communication jack are connected. See U.S. Pat. No. 5,997,358 (Dec. 7, 1999), all relevant portions of which are incorporated by reference. U.S. Pat. No. 6,139,371 (Oct. 31, 2000), also incorporated by reference, relates to a communication connector assembly having capacitive crosstalk compensation. The assembly features a number of terminal contact wires at least first and second pairs of which have free end portions that extend to define leading portions. A leading portion of a first pair of contact wires, and a leading portion of a second pair of contact wires, are dimensioned and arranged for capacitively coupling to one another so as to produce capacitive crosstalk compensation. See also commonly owned U.S. application Ser. No. 09/583,503, filed May 31, 2000, and entitled "Communication Connector with Crosstalk Compensation", and U.S. Pat. No. 5,700,167 (Dec. 23, 1997) which discloses inductive crosstalk compensation circuitry in the form of conductive loops that are printed in mutual coupling relation on a printed wire board.

It is also known that in conventional modular communication plugs, capacitively coupled and inductively coupled signal components add for NEXT, while they subtract for FEXT. That is:

$$NEXT=Xc+Xm$$

and $$FEXT=Xc-Xm,$$

wherein:

Xc is the capacitively coupled component, and

Xm is the inductively coupled component.

It is also known that the effectiveness of any NEXT cancellation scheme is limited by the amount of delay between the offending crosstalk and the compensating crosstalk, and that NEXT cancellation may be improved by reducing such delay with optimum cancellation occurring when the delay is effectively zero. The connector configuration in the mentioned U.S. Pat. No. 6,139,371 minimizes the delay for capacitive crosstalk compensation by deploying the capacitive compensation coupling at non-current carrying free ends of the contact wires in a modular jack, effectively at the connection interface where the offending crosstalk is introduced by the mating plug.

If all existing NEXT is compensated using capacitive coupling at the non-current carrying wire free ends, NEXT would be effectively canceled because delay is minimized. But FEXT performance may be degraded, however, since the compensation being provided is totally capacitive in nature.

Further, if a configuration such as in the '371 patent is used only to cancel the capacitive component of the original crosstalk, and inductive coupling is also provided to compensate for the offending inductive component (see, e.g., U.S. Pat. No. 6,196,880 issued Mar. 16, 2001), FEXT would be minimized but the efficiency of NEXT cancellation may be reduced due to a time delay caused by the remote placement of the inductive compensation which is effectively distributed over the length of the inductive coupling region. Thus, the need to maintain adequately low FEXT levels has been a constraint on the degree to which NEXT levels can be reduced.

SUMMARY OF THE INVENTION

According to the invention, a method of compensating for near-end and far-end crosstalk in a communication connector, includes producing capacitive compensation coupling at a first stage in. the connector wherein the capacitive compensation coupling corresponds in magnitude to a sum of offending capacitive crosstalk and offending inductive crosstalk both of which originate from a mating connector, and producing, at a second stage, both (a) inductive compensation coupling corresponding in magnitude to the offending inductive crosstalk from the mating connector, and (b) capacitive coupling corresponding in magnitude and of a polarity opposite to that of the inductive compensation coupling.

For a better understanding of the invention, reference is made to the following description taken in conjunction with the accompanying drawing and the appended claims.

DETAILED DESCRIPTION OF THE INVENTION

Figure 1:
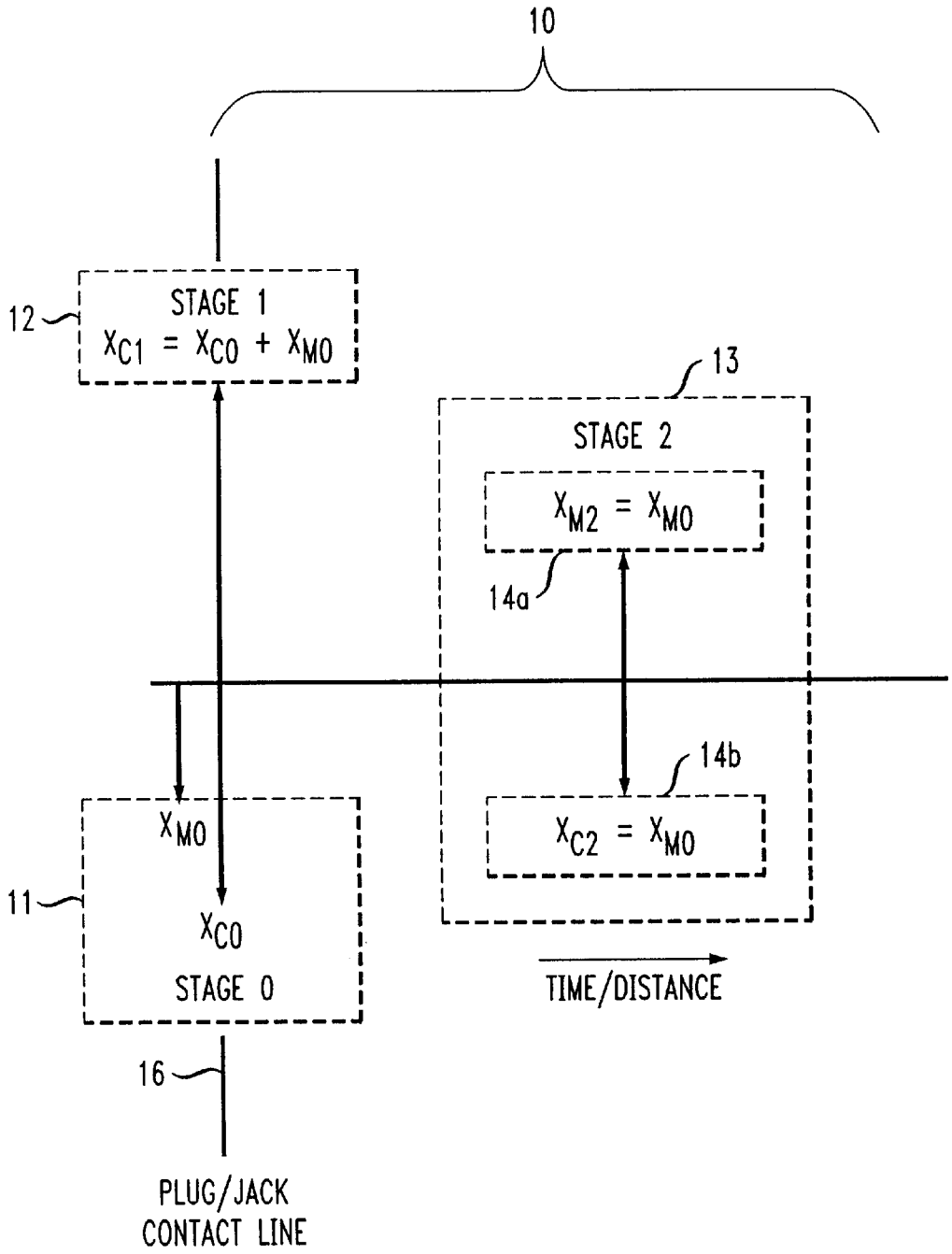
FIG. 1 is a vector representation of the compensation scheme of the invention, as applied in a communication connector.

FIG. 1 is a vector representation of a crosstalk compensation scheme according to the invention, as deployed in a communication connector 10, for example, a modular jack. Two stages 12, 13 of compensation coupling are defined within the connector 10. A mating connector 11, e.g., a communication plug, is assumed to introduce offending crosstalk onto terminal contact wires of the connector 10 at a plug/jack contact line 16. The offending crosstalk, labeled "Stage 0" in FIG. 1, includes an inductive component Xmo and a capacitive component Xco. Typically, the capacitive component Xco follows the inductive component Xmo after only a relatively short delay.

As shown in FIG. 1, capacitive compensation coupling Xc1 of a value the same or approximately equal to Xco+Xmo and of opposite polarity, is introduced at the first stage 12 (Stage 1) of compensation coupling at the plug/jack contact line 16. Such coupling may be implemented, for example, by producing the required value of capacitive compensation coupling at non-current-carrying free ends of the contact wires of the connector 10 according, for example, to the mentioned U.S. Pat. No. 6,139,371. Since the capacitive compensation coupling provided by the first stage 12 is at a minimal delay with respect to the total offending crosstalk introduced at the plug/jack contact line 16 (stage 0), and because the compensation coupling provided by the first stage 12 is equal in magnitude and of opposite polarity to the total offending crosstalk, optimum NEXT cancellation is achieved.

To cancel FEXT without degrading NEXT, the second stage 13 of compensation coupling is provided as shown in FIG. 1. Part 14*a* of the second stage is configured to produce an inductive compensation coupling component Xm2 that is equal in magnitude and of opposite polarity to the inductive component Xmo of the. offending crosstalk introduced by the mating connector at the plug/jack contact line 16. Part 14*b* of the second stage 13 is configured to produce a capacitive coupling component Xc2 that is equal in magnitude to the inductive compensation component Xm2, but of opposite polarity. To be self-canceling, the two components Xc2, Xm2 should be introduced at substantially the same physical location in the connector 10.

It can be seen in FIG. 1 that the second stage 13 produces the required capacitive-for-capacitive and inductive-for-inductive compensations needed to cancel FEXT. Although the first and the second stages 12, 13 are delayed from one another, FEXT cancellation is substantially delay insensitive and is not significantly affected. Also, the second stage 13 is selfcanceling, and can be conveniently positioned in time or distance with respect to the first stage 12, without degrading NEXT performance. Further, the parts 14*a*, 14*b* of the second stage 13 can be placed at an offset from one another, to fine tune any remaining residual crosstalk resulting from a finite delay between the offending crosstalk introduced at stage 0, and the first stage 12 of compensation coupling in the connector 10.

Accordingly, to compensate for both NEXT and FEXT simultaneously, the capacitive component Xco of the offending crosstalk is effectively canceled by capacitively coupled crosstalk of equal magnitude and opposite polarity, and the offending inductive component Xmo is effectively canceled by inductively induced crosstalk of equal magnitude and opposite polarity. Since the components Xc2 and Xm2 have opposite polarity, their relative delay may be favorably chosen for canceling any residual NEXT.

Actually, three compensations may be considered as occurring simultaneously. A part of the first stage 12 component Xc1 cancels the capacitive component Xc0 of the offending crosstalk. The remaining part of Xc1 cancels the compensation coupling component Xc2 of the second stage 13 with a residual crosstalk vector shifted by +90 degrees, and the inductive compensation coupling component Xm2 of the second stage 13 cancels the inductive component Xmo of the offending crosstalk with a residual crosstalk vector of like magnitude but shifted by −90 degrees. Since the two residual crosstalk vectors have opposing phase, they cancel one another.

In other, more generalized implementations of the present scheme, the components Xc1 and Xc2 may be varied in magnitude about their initially determined values for purposes of fine tuning.

Figure 2:
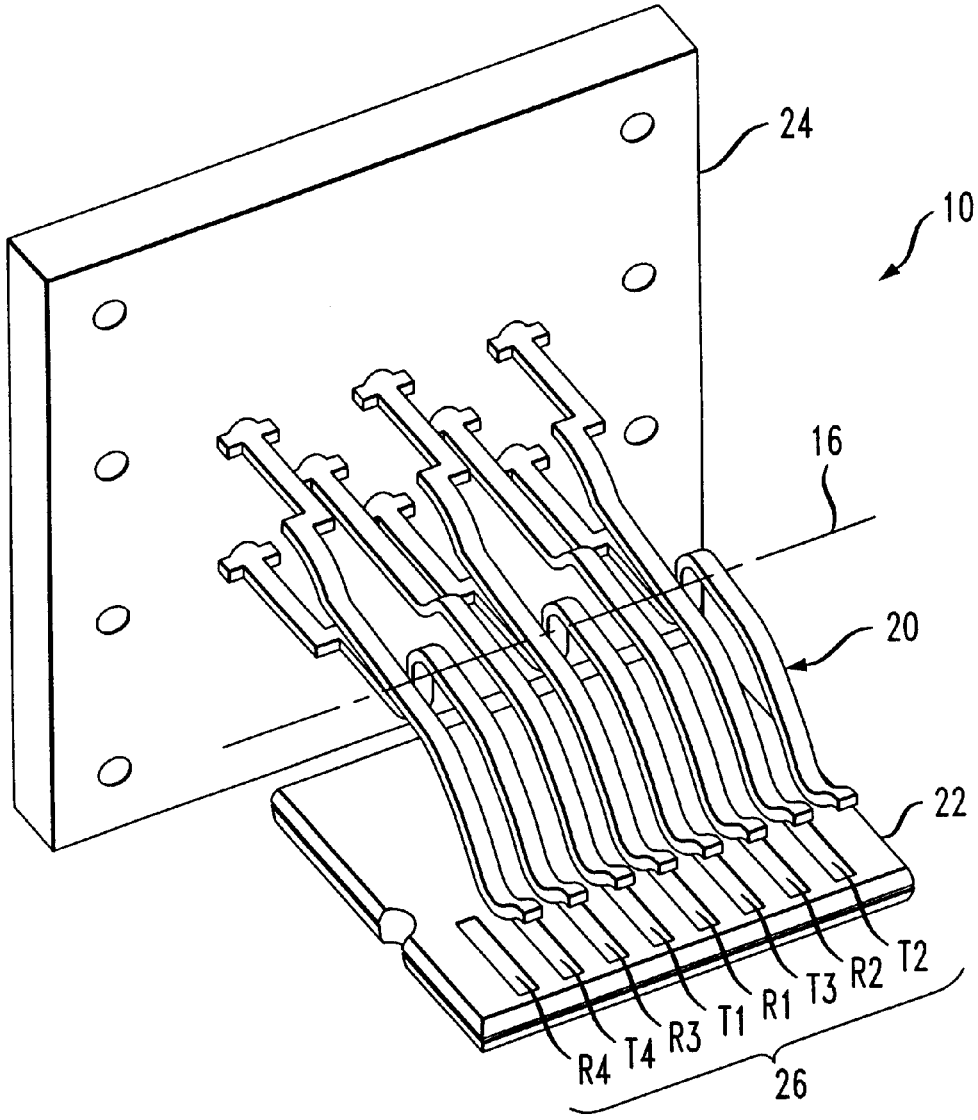
FIG. 2 is a perspective view of a portion of the connector of FIG. 1.

FIG. 2 is a perspective view of a front portion of one embodiment of the connector 10, showing four pairs of contact wires 20, a first printed wiring board 22, and a second printed wiring board 24. An outer connector housing and associated structure are omitted in the figure for purposes of clarity.

The first printed wiring board 22 has an array of contact pads 26 in proximity to a front edge of the board. The pads 26 are aligned beneath corresponding free ends of the contact wires 20. When terminals of a mating plug connector (not shown) engage the contact wires at the plug/jack contact line 16, the contact wires deflect resiliently downward and their free ends establish electrical contact with the corresponding pads 26. Certain values of capacitance are provided on or within the board 22, between selected pairs of the contact pads 26 in order to implement the first stage 12 of compensation coupling in the connector 10. For example, a capacitance of 1.02 pf between pads labeled T(tip)1 and T3, and a capacitance of 1.02 pf between the pads labeled R(ring)1 and R3. See commonly owned U.S. application Ser. No. 09/664,814 filed Sep. 19, 2000, and entitled "Low Crosstalk Communication Connector", all relevant portions of which are incorporated by reference.

In FIG. 2, the fourth and the fifth contact wires from the left are aligned with contact pads labeled T1 and R1, and they define a first signal path (pair 1) through the connector 10. The third and the sixth contact wires, aligned with pads labeled R3 and T3, define a different signal path (pair 3) through the connector 10. In typical industry type RJ-45 communication connectors using TIA wiring method T568B, a greatest amount of offending crosstalk is developed in plug connectors among the pair 1 and the pair 3 signal paths.

Figure 3:
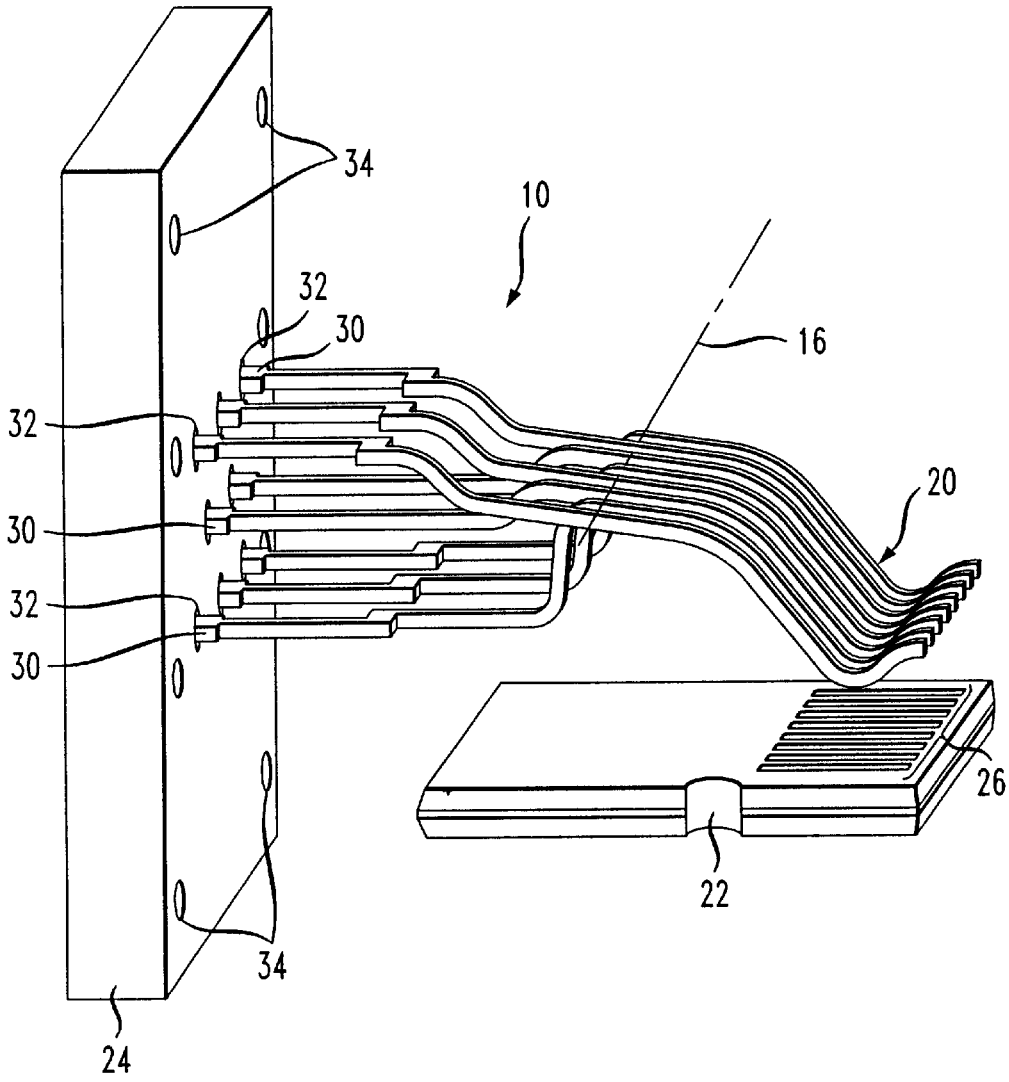
FIG. 3 is a side view of the connector shown in FIG. 2.

The terminal contact wires 20 are supported above the first printed wiring board 22 by the second printed wiring board 24. As seen in FIG. 3, bases 30 of the contact wires 20 are press-fit or otherwise fixed in corresponding terminal openings 32 formed in the wiring board 24. The wiring board 24 has a second set of terminal openings 34 arrayed next to vertical side edges of the board 24 for supporting connector terminals (not shown) which are coupled via wire traces on the board to the bases 30 of the contact wires.

The second wiring board 24 includes circuitry (shown in FIGS. 6 and 7) used to implement both parts 14*a* and 14*b* of the second stage 13 of compensation coupling. Because the second stage 13 at the second wiring board 24 is physically separated from the first wiring board 22, it is preferred that no significant crosstalk be allowed to develop among intermediate portions of the contact wires between the plug/jack contact line 16 and the wiring board 24.

Figure 4:
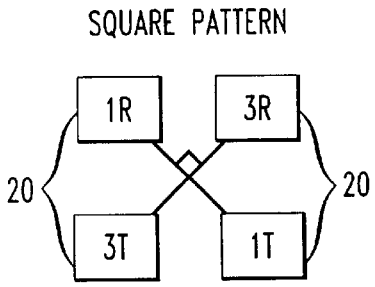
FIG. 4 represents a first configuration of intermediate portions of contact wires in the connector.
Figure 5:
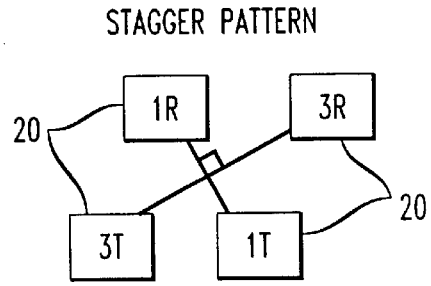
FIG. 5 represents a second configuration of the intermediate portions of the contact wires in the connector.

Thus, as shown in FIGS. 4 and 5, the cross-sections of the pair 1 contact wires (1T and 1R), are aligned at right angles to and bisect a line drawn between the cross-sections of the pair 3 contact wires (3R and 3T). FIG. 4 represents a "square" pattern, and FIG. 5 shows a "stagger" pattern for the contact wires, both of which satisfy a symmetric and mutually orthogonal alignment for the pair 1 and the pair 3 contact wires between the plug/jack contact line 16, and the bases 30 of the contact wires at the second wiring board 24.

Figure 6:
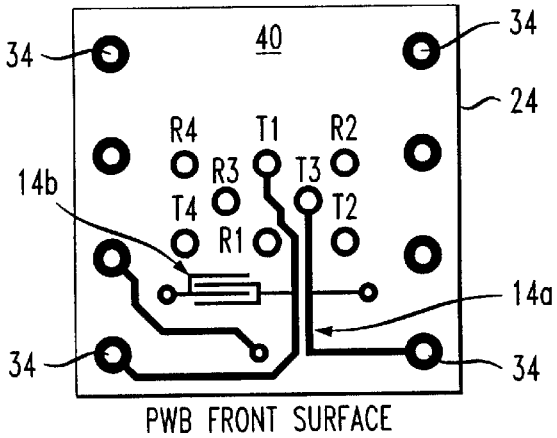
FIG. 6 is a view of a front surface of a printed wiring board in the connector.
Figure 7:
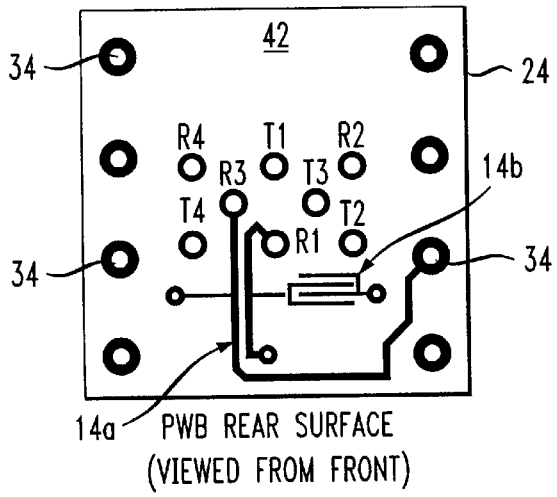
FIG. 7 is a view of a rear surface of the printed wiring board in FIG. 6, as viewed from the front.

FIG. 6 is a view of a front surface 40 of the second wiring board 24, and FIG. 7 is a view of a rear surface 42 of the wiring board 24 as viewed from the front. As seen in FIGS. 6 and 7, the pair 1 and the pair 3 contact wires enter the wiring board 24 with the square pattern of FIG. 4. The capacitive component part 14*b* of the second stage 13, is at or near a centroid of the inductive component part 14*a* and of opposite polarity. The embodiment of FIGS. 6 and 7 uses a wiring board trace layout that generates inductive coupling using mutually facing loop traces, as in the mentioned U.S. Pat. No. 5,700,167. Opposite polarity capacitive coupling is implemented by interdigital comb traces on the board at 14*b*, and is applied at the centers of the inductive loops at 14*a*. Also, if necessary, a capacitive compensation element (not shown) may be provided on the wiring board 24 at the bases 30 of the contact wires, to compensate for any undesired crosstalk coupling among the intermediate portions of the pair 1 and the pair 3 contact wires.

EXAMPLE

The two-stage crosstalk compensation scheme of FIG. 1 was simulated using a SPICE simulation program. Offending crosstalk was introduced at the plug/jack contact line 16 with a capacitive component Xco=10 mv/v, and an inductive component Xmo=6 mv/v. Stage 1 compensation coupling with Xc1=16 mv/v was produced at the plug/contact line 16. Stage 2 compensation coupling was simulated at a distance corresponding to a delay of 100 picoseconds from the stage 1 location, with Xc2=6 mv/v and Xm2=6 mv/v. Results showed that NEXT loss was 65.1 dB at 100 MHz, and FEXT loss was 101 dB at 100 MHz. Without the stage 2 compensation, NEXT and FEXT losses were measured at 58.2 dB and 39.2 dB, respectively. Thus, according to the simulation results, the stage 2 compensation enabled Category 6 performance to be attained for the connector 10.

While the foregoing description represents preferred embodiments of the invention, it will be appreciated that various changes and modifications may be made without departing from the spirit and scope of the invention pointed out by the following claims.

We claim:

1. A communication jack assembly, comprising:

a first printed wiring board having associated capacitance elements with corresponding capacitance contact pads;

a second printed wiring board and at least a first and a second pair of contact wires, wherein each of the contact wires has a base supported on the second board, a free end, and an intermediate portion extending between the base and the free end, and the intermediate portion has an ice for establishing an electrical connection with a corresponding terminal of a mating plug connector;

the capacitance contact pads on the first printed wiring board are aligned beneath corresponding free ends of the contact wires so that the free ends establish electrical contact with the pads when the contact wires are engaged by the plug connector;

the capacitance elements of the first board forming part of a first crosstalk compensation stage for providing a first level of capacitive compensation coupling corresponding in magnitude to a sum of offending capacitive crosstalk and offending inductive crosstalk to be introduced to the jack assembly by the mating plug connector; and the second board having capacitance and inductance elements for forming part of a second crosstalk compensation stage for providing both (a) a level of inductive compensation coupling, though trace layout of conductive traces on said second board which communicate with at least one of said first and second pairs of contact wires, that corresponds in magnitude to the offending inductive crosstalk generated from the plug connector, and (b) a second level of capacitive coupling that corresponds in magnitude and has a polarity opposite to that of the level of inductive compensation coupling;

wherein near end crosstalk (NEXT) and far end crosstalk (FEXT) that would otherwise be produced when the jack assembly is engaged by the mating plug connector, are compensated by the compensation crosstalk provided by the first and the second crosstalk compensation stages in the jack assembly.

2. The communication jack assembly of 1, wherein the second stage is configured so that the second level of capacitive coupling is applied at or near a centroid of the first level of inductive compensation coupling.

3. The communication jack assembly of claim 1, wherein the first and the second pairs of contact wires are supported in a pattern that minimizes crosstalk coupling among the intermediate portions of the first and the second pairs of contact wires.

4. The communication jack assembly of claim 3, wherein cross-sections of the intermediate portions of the first and the second pairs of contact wires are aligned at corners of a rectangular pattern having diagonals that bisect and are orthogonal to one another.

5. The communication jack assembly if claim 4, wherein the cross-sections of the intermediate portions of the first and the second pairs of contact wires are aligned at diagonally opposite corners of a square pattern.

6. A method of compensating for near end crosstalk (NEXT) and far end crosstalk (FEXT) that would otherwise be produced when a first communication connector is engaged with a second communication connector at a contact zone by electrical contact of the first connector through a first pair and a second pair of contact wires for establishing electrical connections between the first and second connectors through engagement, by free ends of the contact wires, of contact regions on the first connector, wherein the second connector introduces a known level of offending capacitive crosstalk and a known level of offending inductive crosstalk to the first connector, the method comprising:

producing, at a first stage arranged in the first connector, a first level of capacitive compensation coupling by connecting a first capacitive element between said contact wire pairs in a region defined between the contact zone and the free ends, said first level corresponding in magnitude to a sum of the offending capacitive crosstalk and the offending inductive crosstalk introduced by the second connector; and producing, at a second stage arranged in the first connector and following the first stage, both (a) a level of inductive compensation coupling through conductor arrangement at said second stage, said level of inductive compensation corresponding in magnitude to the offending inductive crosstalk from the second connector, and (b) a second level of capacitive coupling by connecting a second capacitive clement between said contact wire pairs outside of said region, said second level of capacitive coupling corresponding in magnitude and having a polarity opposite to that of the level of inductive compensation coupling.

7. The method of claim 6, including connecting the first stage of capacitive compensation coupling in the first connector to free ends of the contact wires.

8. The method of claim 7, including providing a printed wiring board with capacitance element terminals in the first connector, and urging the free ends of the contact wires against the capacitance element terminals by action of the mating second connector.

9. The method of claim 6, including configuring the second stage so that the second level of capacitive coupling is applied at or near a centroid of the first level of inductive compensation coupling.

10. The method of claim 6, including supporting the contact wires in the first connector in a pattern that minimizes crosstalk coupling among intermediate portions of the first and the second pairs of contact wires.

11. The method of claim 10, including aligning cross-sections of the intermediate portions of the first and the second pairs of contact wires at corners of a rectangular pattern having diagonals that bisect and are orthogonal to one another.

12. The method of claim 11, including maintaining the cross-sections of the intermediate portions of the first and the second pairs of contact wires at diagonally opposite corners of a square pattern.

* * * * *